US008370164B2

(12) United States Patent
Beack et al.

(10) Patent No.: US 8,370,164 B2
(45) Date of Patent: Feb. 5, 2013

(54) APPARATUS AND METHOD FOR CODING AND DECODING MULTI-OBJECT AUDIO SIGNAL WITH VARIOUS CHANNEL INCLUDING INFORMATION BITSTREAM CONVERSION

(75) Inventors: Seung-Kwon Beack, Seoul (KR); Jeong-Il Seo, Daejon (KR); Tae-Jin Lee, Daejon (KR); Yong-Ju Lee, Daejon (KR); Dae-Young Jang, Daejon (KR); Jin-Woo Hong, Daejon (KR); Jin-Woong Kim, Daejon (KR); Kyeong-Ok Kang, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 894 days.

(21) Appl. No.: 12/521,433

(22) PCT Filed: Dec. 27, 2007

(86) PCT No.: PCT/KR2007/006910
§ 371 (c)(1),
(2), (4) Date: Jun. 26, 2009

(87) PCT Pub. No.: WO2008/078973
PCT Pub. Date: Jul. 3, 2008

(65) Prior Publication Data

US 2010/0114582 A1 May 6, 2010

(30) Foreign Application Priority Data

Dec. 27, 2006 (KR) ..... 10-2006-0135400
Jan. 12, 2007 (KR) ..... 10-2007-0003897
Jan. 25, 2007 (KR) ..... 10-2007-0007724

(51) Int. Cl.
*G10L 19/00* (2006.01)
*G10L 19/02* (2006.01)
*H04H 20/47* (2008.01)

(52) U.S. Cl. ..... 704/503; 704/500; 704/270; 704/225; 381/182; 381/58; 381/119; 381/98; 381/22; 700/94

(58) Field of Classification Search ..... 704/270, 704/500–504, 225, 201; 345/473; 715/202; 379/202.01; 381/182, 58, 310, 119, 98, 17, 381/22; 709/204, 227; 707/756, 760; 700/94
See application file for complete search history.

(56) References Cited

U.S. PATENT DOCUMENTS 5,815,689 A * 9/1998 Shaw et al. ..... 713/400
8,073,125 B2 * 12/2011 Zhang et al. ..... 379/202.01
(Continued)

FOREIGN PATENT DOCUMENTS

JP 2010-505328 A1 2/2010
WO 2006/098583 A1 9/2006
(Continued)

OTHER PUBLICATIONS

International Search Report; PCT/KR2007/006910.
(Continued)

*Primary Examiner* — Vijay B Chawan
(74) *Attorney, Agent, or Firm* — Ladas & Parry LLP

(57) ABSTRACT

Provided is an apparatus and method for coding and decoding multi-object audio signals with various channels and providing backward compatibility with a conventional spatial audio coding (SAC) bitstream. The apparatus includes: an audio object coding unit for coding audio-object signals inputted to the coding apparatus based on a spatial cue and creating rendering information for the coded audio-object signals, where the rendering information provides a coding apparatus including spatial cue information for audio-object signals; channel information of the audio-object signals; and identification information of the audio-object signals, and used in coding and decoding of the audio signals.

23 Claims, 8 Drawing Sheets

U.S. PATENT DOCUMENTS

| | | | | |
|---|---|---|---|---|
| 8,271,289 | B2 * | 9/2012 | Kim et al. | 704/500 |
| 2007/0269063 | A1 * | 11/2007 | Goodwin et al. | 381/310 |
| 2008/0004729 | A1 * | 1/2008 | Hiipakka | 700/94 |
| 2010/0030563 | A1 * | 2/2010 | Uhle et al. | 704/500 |
| 2010/0076772 | A1 * | 3/2010 | Kim et al. | 704/500 |
| 2010/0174548 | A1 * | 7/2010 | Beack et al. | 704/503 |
| 2011/0015770 | A1 * | 1/2011 | Seo et al. | 700/94 |

FOREIGN PATENT DOCUMENTS

| | | | |
|---|---|---|---|
| WO | 2006/103581 | A1 | 10/2006 |
| WO | 2006/108573 | A1 | 10/2006 |
| WO | 2006/126856 | A2 | 11/2006 |
| WO | WO2008/039042 | A1 | 4/2008 |

OTHER PUBLICATIONS

Seungkwon Beack, et al; "Angle-Based Virtual Source Location Representation for Spatial Audio Coding", ETRI Journal, vol. 28, No. 2, Apr. 2006, pp. 219-222 (Exact date not given in journal paper).

* cited by examiner

APPARATUS AND METHOD FOR CODING AND DECODING MULTI-OBJECT AUDIO SIGNAL WITH VARIOUS CHANNEL INCLUDING INFORMATION BITSTREAM CONVERSION

TECHNICAL FIELD

The present invention relates to an apparatus and a method for coding and decoding multi-object audio signals with various channels; and, more particularly, to an apparatus and method for coding and decoding multi-object audio signals with various channels including side information bitstream conversion for transforming side information bitstream and recovering multi-object audio signals with a desired output signal, i.e., various channels, based on transformed side information bitstream.

Multi-object audio signals with various channels signify audio signals for multiple objects having different channels e.g., mono, stereo, and 5.1 channels, for each of the audio objects.

This work was supported by the IT R&D program for MIC/IITA [2005-S-403-02, "Development of Super-intelligent Multimedia Anytime-anywhere Realistic TV SmarTV Technology"].

BACKGROUND ART

According to a conventional audio coding/decoding technology, users should inactively listen to audio content. Thus, it is required to develop an apparatus and method for coding and decoding audio signals in multi-channels for a plurality of audio objects so that various audio objects can be consumed by controlling audio objects each of which having a different channel according to a user's need, and combining one audio content in various methods.

Conventional spatial audio coding (SAC) is a technology for representing, transmitting and recovering multi-channel audio signals as downmixed mono or stereo signals, and it can transmit multi-channel audio signal of a high-quality at a low bit rate.

However, since the conventional SAC is capable of coding and decoding signals in multi-channels only for one audio object, it cannot code/decode a multi-channel and multi-object audio signals, for example, audio signals for various objects in multi-channels, e.g., mono, stereo and 5.1 channels.

Also, conventional Binaural Cue Coding (BCC) technology can code/decode audio signals for multiple objects. However, since the channels of the audio objects are limited to a mono channel, multi-object audio signals with various channels including the mono channel may not be coded/decoded.

To sum up, since the conventional technologies can code/decode only multi-object audio signals with a single channel or a single-object audio signal with multi-channel, multi-object audio signals with various channels may not be coded/decoded. Therefore, users should inactively listen to audio contents according to the conventional audio coding/decoding technologies.

Accordingly, it is required to develop an apparatus and method for coding and decoding audio signals in various channels for each of multiple audio objects to consume various audio objects by controlling each audio object in mulitple channels, which are different according to a user's need, and combining one audio content according to various methods.

Also, an apparatus and method for converting multi-object audio bitstream into a conventional SAC bitstream and vice versa is required to provide backward compatibility between side information bitstream created in a multi-object audio coder and side information bitstream of a conventional SAC coder/decoder.

As described above, as the apparatus and method for coding and decoding the multi-object audio signal of various channels by individually control a plurality of audio objects with different channels and combining one audio content according to various methods, it is required to develop a multi-channel and the multi-object audio coding and decoding apparatus and method which can perform bitstream conversion to provide backward compatibility with the conventional SAC bitstream, and control each of the multiple audio objects having multi-channels to thereby combine one audio objects in diverse methods.

DISCLOSURE

Technical Problem

An embodiment of the present invention is directed to providing an apparatus and method for coding and decoding multi-object audio signals with various channels to provide a backward compatibility with a conventional spatial audio coding (SAC) bitstream.

Technical Solution

In accordance with an aspect of the present invention, there is provided an apparatus for coding multi-object audio signals, including: an audio object coding unit for coding audio-object signals inputted to the coding apparatus based on a spatial cue and creating rendering information for the coded audio-object signals, where the rendering information includes spatial cue information for the audio-object signals, channel information of the audio-object signals, and identification information of the audio-object signals.

In accordance with another aspect of the present invention, there is provided a transcoding apparatus for creating rendering information for decoding multi-object audio signals, including: a first matrix unit for creating rendering information including power gain information and output location information for coded audio-object signals based on object control information and play information for the coded audio-object signal; and a rendering unit for creating spatial cue information for audio signals to be outputted from a decoding apparatus based on the rendering information created by the first matrix unit and rendering information for the coded audio-object signal inputted from a coding apparatus.

In accordance with another aspect of the present invention, there is provided a transcoding apparatus for creating multi-channel audio signals and rendering information for decoding the multi-channel audio signal, including: a parsing unit for separating rendering information for coded audio-object signals and rendering information for multi-channel audio signals from rendering information for coded audio signals inputted from a coding apparatus; a first matrix unit for creating rendering information including power gain information and output location information for the coded audio-object signals based on object control information and play information for the coded audio-object signals; a second matrix unit for creating rendering information including power gain information of each channel for the multi-channel audio signals based on the rendering information for the coded multi-channel audio signals separately acquired by the parsing unit; and a rendering unit for creating spatial cue information for the audio signals outputted from a decoding apparatus based on the rendering information created by the first matrix unit, the rendering information created by the second matrix unit, and the rendering information for the coded audio-object signals separately acquired by the parsing unit.

In accordance with another aspect of the present invention, there is provided a method for coding multi-object audio signals, including the steps of: coding inputted audio-object signals based on a spatial cue and creating rendering information for the coded audio-object signals, where the rendering information includes spatial cue information for the audio-object signals, channel information of the audio-object signals, and identification information of the audio-object signals.

In accordance with another aspect of the present invention, there is provided a transcoding method for creating rendering information for decoding multi-object audio signals, including the steps of: creating rendering information including power gain information and output location information for coded audio-object signals based on object control information and play information for the coded audio-object signals; and creating spatial cue information for audio signals to be outputted after decoding based on rendering information created in the step of creating rendering information and rendering information for the coded audio-object signals inputted after coding.

In accordance with another aspect of the present invention, there is provided a transcoding method for creating rendering information for decoding multi-channel audio signals and multi-object audio signals, including the steps of: separating rendering information for coded audio-object signals and rendering information for the multi-channel audio signal from rendering information for the coded audio signals inputted after coding; creating rendering information including power gain information and output location information for the coded audio-object signals based on object control information and play information for the coded audio-object signals; creating rendering information including power gain information of each channel for the multi-channel audio signals based on rendering information for the coded multi-channel audio signals separately acquired in the step of separating rendering information; and creating spatial cue information for audio signals to be outputted after decoding based on the rendering information created in the step of creating rendering information including power gain information and output location information, the rendering information created in the step of creating rendering information including power gain information of each channel for multi-channel audio signal, and the rendering information for the coded audio-object signal separately acquired in the step of separating rendering information.

Advantageous Effects

The present invention can actively consume audio contents according to a user's needs by efficiently coding and decoding multi-object audio contents in various channels by providing an apparatus and method for coding and decoding multi-object audio signals with various channels capable of performing an side information bitstream conversion. Also, the present invention can provide compatibility with a conventional coding and decoding apparatus by providing backward compatibility with conventionally used bitstream.

BEST MODE FOR THE INVENTION

The advantages, features and aspects of the invention will become apparent from the following description of the embodiments with reference to the accompanying drawings, which is set forth hereinafter. Specific embodiments of the present invention will be described in detail hereinafter with reference to the attached drawings.

Figure 1:
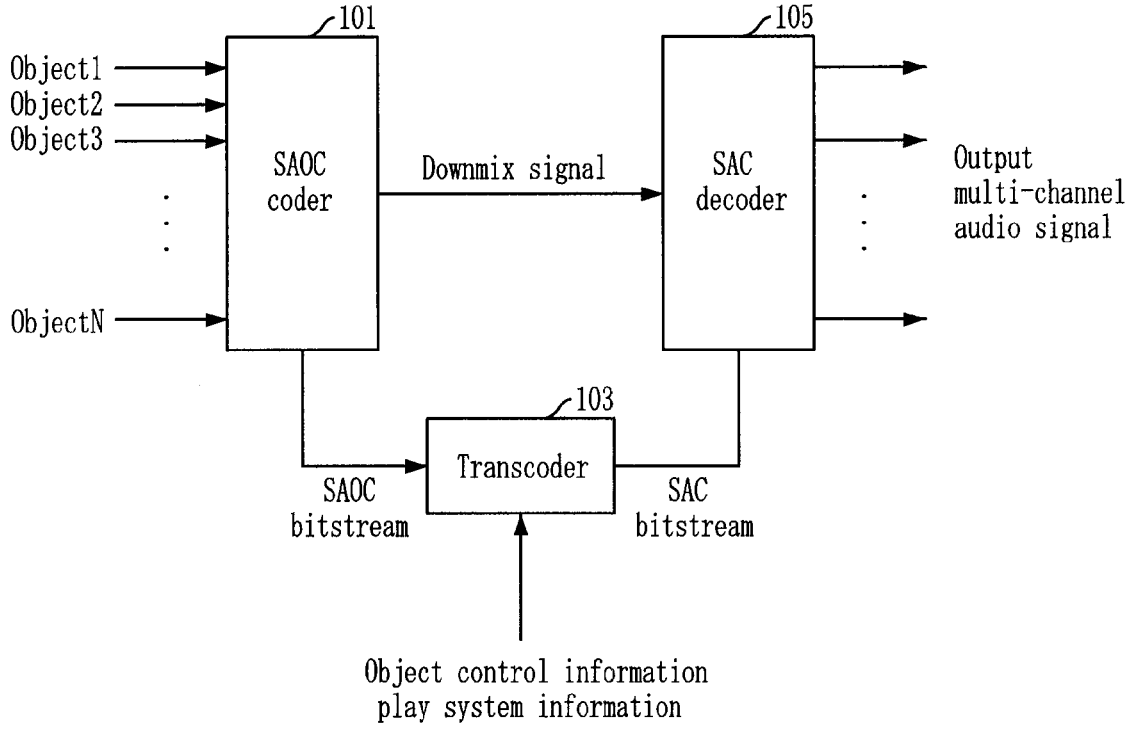
FIG. 1 is a block diagram showing a multi-object audio coder and a multi-object decoder in accordance with an embodiment of the present invention.

FIG. 1 is a block diagram showing a multi-object audio coder and a multi-object decoder in accordance with an embodiment of the present invention.

Referring to FIG. 1, the present invention includes a spatial audio object coder (SAOC) 101, a transcoder 103 and a spatial audio coding (SAC) 105.

According to the SAOC method, a signal inputted to the coder is coded as an audio object. Each audio object is not recovered by the decoder and independently played. However, information for the audio object is rendered to form a desired audio scene and multi-object audio signals with various channels is outputted. Therefore, the SAC decoder requires an apparatus for rendering information for an audio object inputted to acquire the desired audio scene.

The SAOC coder 101 is a coder based on a spatial cue and codes the input audio signal as an audio object. The audio object is a mono or stereo signal inputted to the SAOC coder 101.

The SAOC coder 101 outputs downmix signals from more than one inputted audio object and creates an SAOC bitstream by extracting a spatial cue and side information. The outputted downmix signals are mono or stereo signals. The SAOC coder 101 analyzes inputted audio-object signals based on a "heterogeneous layout SAOC" or "Faller" technique.

The extracted SAOC bitstream includes a spatial cue and side information and the side information includes spatial information of the input audio objects. The spatial cue is generally analyzed and extracted on the basis of a frequency region subband unit.

The spatial cue is information used in coding and decoding audio signals. It is extracted from a frequency region and includes information for size difference, delay difference and correlation between inputted two signals. For example, the spatial cue includes channel level difference (CLD) between audio signals showing power gain information of the audio signal, inter-channel level difference (ICLD) between audio signals, inter-channel time difference (ICTD) between audio signals, correlation inter-channel correlation (ICC) between audio signals showing correlation information between audio signals, and virtual source location information between audio signals but is not limited to these examples.

Also, the side information includes information for recovering and controlling the spatial cue and the audio signal. The side information includes header information. The header information includes information for recovering and playing the multi-object audio signal with various channels and can provide decoding information for the audio object with a mono, stereo, or multi-channel by defining channel information for the audio object and identification (ID) of the audio object. For example, ID and information for each object is defined to identify whether a coded specific audio object is a mono audio signal or a stereo audio signal. The header information may include spatial audio coding (SAC) header information, audio object information and preset information as an embodiment.

The transcoder 103 renders the audio object inputted to the SAOC coder 101 and transforms an SAOC bitstream extracted from the SAOC coder 101 into an SAC bitstream based on a control signal inputted from outside, i.e., sound information and play environment information of each object.

That is, the transcoder 103 performs rendering based on the SAOC bitstream extracted to recover the audio object inputted to the SAOC coder 101 as multi-object audio signals with various channels. The rendering based on the side information may be performed in a parameter region.

Also, the transcoder 103 transforms the SAOC bitstream into the SAC bitstream. The transcoder 103 obtains information of the input audio objects from the SAOC bitstream and renders the information of the input audio objects correspondingly to a desired audio scene. In the rendering procedure, the transcoder 103 predicts spatial information corresponding to the desired audio scene, transforms and outputs the predicted spatial information as an SAC side information bitstream.

The transcoder 103 will be described in detail with reference to FIG. 3.

The SAC decoder 105 is a multi-channel audio decoder based on a spatial cue, recovers a downmix signal outputted from the SAOC coder 101 as an audio signal of each object based on the SAC bitstream outputted from the transcoder 103, and recovers the audio signal of each object as multi-object audio signals with various channels. The SAC decoder 105 may be replaced by a Motion Picture Experts Group (MPEG) surround decoder and a binaural cue coding (BCC) decoder.

Figure 2:
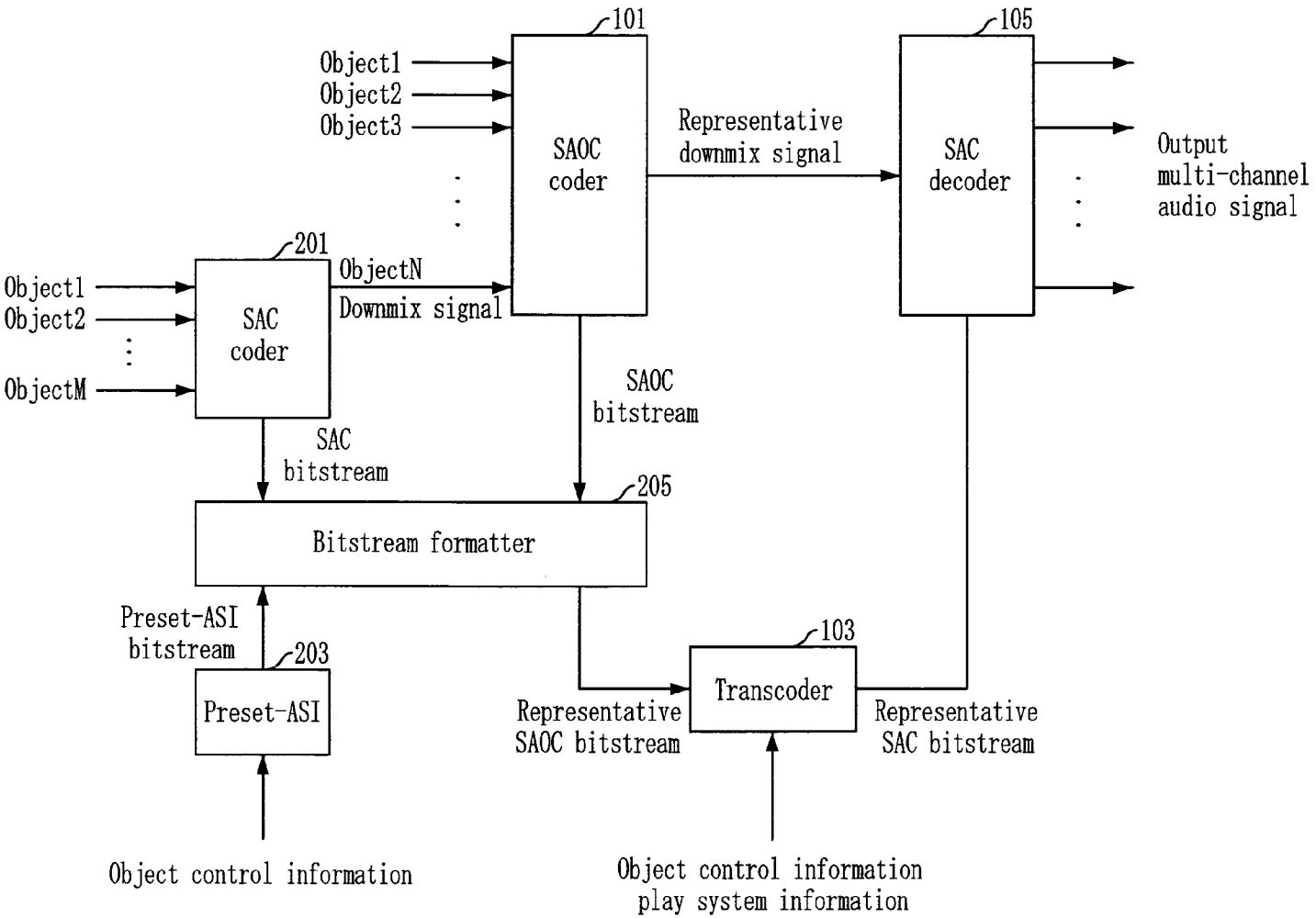
FIG. 2 is a block diagram showing a multi-object audio coder and a multi-object decoder in accordance with an embodiment of the present invention.

FIG. 2 is a block diagram showing a multi-object audio coder and a multi-object decoder in accordance with an embodiment of the present invention and shows a case that an input signal is a multi-object audio signal with various channels.

Referring to FIGS. 2 and 1, the present invention includes the SAOC coder 101, the transcoder 103, the SAC decoder 105, an SAC coder 201, a preset-audio scene information (ASI) 203 and a bitstream formatter 205.

When the SAOC coder 101 supports only a mono or stereo audio object, the SAC coder 201 outputs one audio object from an inputted multi-channel audio signal. The outputted audio object is a downmixed mono or stereo signal. Also, the SAC coder 201 extracts the spatial cue and the side information and creates an SAC bitstream.

The SAOC coder 101 outputs a representative downmix signal from more than one audio object including one audio object outputted from the SAC coder 201, extracts the spatial cue and the side information and creates SAOC bitstream.

The preset-ASI 203 forms a control signal inputted from outside, i.e., sound information and play environment information of each object, as preset-ASI, and creates a preset-ASI bitstream including the preset-ASI. The preset-ASI will be described in detail with reference to FIG. 4.

The bitstream formatter 205 creates a representative SAOC bitstream based on the SAOC bitstream created by the SAOC coder 101, the SAC bitstream created by the SAC coder 201, and the preset-ASI bitstream created by the preset-ASI 203.

The transcoder 103 renders the audio object inputted to the SAOC coder 101 and transforms the representative SAOC bitstream created by the bitstream formatter 205 into a representative SAC bitstream based on sound information and play environment information of each object inputted from outside. The transcoder 103 is included in the SAC decoder 105 and functions as described above.

The SAC decoder 105 recovers a downmix signal outputted from the SAOC coder 101 as multi-object audio signals with various channels based on the SAC bitstream outputted from the transcoder 103. The SAC decoder 105 may be replaced by the MPEG surround decoder and the BCC decoder.

Figure 3:
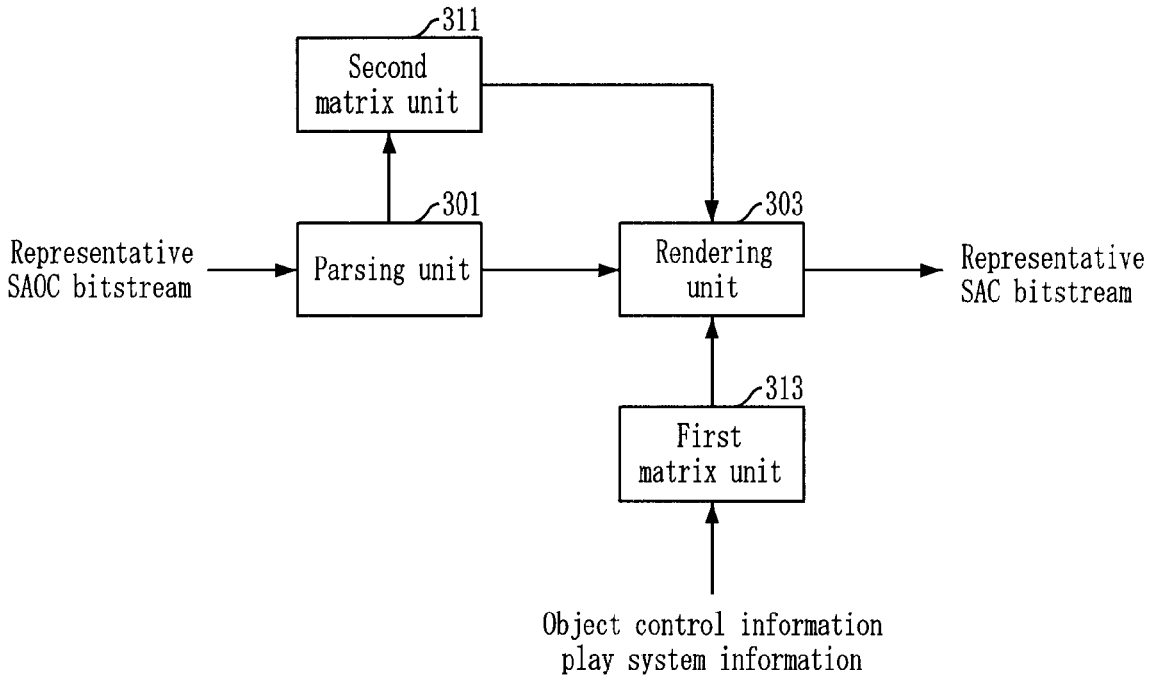
FIG. 3 is a block diagram illustrating a transcoder 103 of FIG. 2 in accordance with an embodiment of the present invention.

FIG. 3 is a block diagram illustrating a transcoder 103 of FIG. 2 in accordance with an embodiment of the present invention.

Referring to FIG. 3, the transcoder 103 includes a parsing unit 301, a rendering unit 303, a second matrix unit 311 and a first matrix unit 313 and transforms representative SAOC bitstream into representative SAC bitstream.

In FIG. 1, the transcoder 103 transforms SAOC bitstream into SAC bitstream.

The parsing unit 301 parses the representative SAOC bitstream created by the bitstream formatter 205 or the SAOC bitstream created by the SAOC coder 101 of FIG. 1, and divides the SAOC bitstream included in the representative SAOC bitstream and the SAC bitstream. Also, the parsing unit 301 extracts information for the number of audio objects inputted from the divided SAOC bitstream to the SAOC coder 101. Since there is no SAC bitstream when the SAOC bitstream created by the SAOC coder 101 of FIG. 1 is parsed, the SAC bitstream does not have to be divided.

The second matrix unit 311 creates a second matrix based on the SAC bitstream divided by the parsing unit 301. The second matrix is a determinant on the multi-channel audio signal inputted to the SAC coder 201. When the SAC bitstream is not included in the representative SAOC bitstream, i.e., when the SAOC bitstream created by the SAOC coder 101 of FIG. 1 is parsed, the second matrix unit 311 is unnecessary.

The second matrix shows a power gain value of the multi-channel audio signal inputted to the SAC coder 201 and is shown in Equation 1.

$$\underbrace{\begin{bmatrix} w^b_{ch_1} \\ w^b_{ch_2} \\ \vdots \\ w^b_{ch_M} \end{bmatrix}_{SAC}}_{Matrix\ II} [u^b_{SAC}(k)] = [Y^b_{SAC}(k)] = \begin{bmatrix} y^b_{ch_1}(k) \\ y^b_{ch_2}(k) \\ \vdots \\ y^b_{ch_M}(k) \end{bmatrix} \quad \text{Eq. 1}$$

Generally, analyzing after dividing one frame into subbands is a basic analyzing procedure of the SAC.

$u_{SAC}^{b}(k)$ is a downmix signal outputted from the SAC coder 201; k is a frequency coefficient index; and b is a subband index. $w_{ch\text{-}i}^{b}$ is spatial cue information of a multi-channel signal obtained from the SAC bitstream and is used to recover frequency information of $i^{th}$ channel signal $1 \leqq i \leqq M$. Therefore, $w_{ch\text{-}i}^{b}$ be expressed as size information or phase information of a frequency coefficient. Therefore, at a right term of Equation 1, $Y_{SAC}^{b}(k)$ is a result of Equation 1 and shows a multi-channel audio signal outputted from the SAC decoder 105.

$u_{SAC}^{b}(k)$ and $w_{ch\text{-}i}^{b}$ are vectors and a transpose matrix dimension of $u_{SAC}^{b}(k)$ is a dimension of $w_{ch\text{-}i}^{b}$. For example, this will be described as Equation 2. Since the downmix signal outputted from the SAC coder 201 is mono or stereo, m is 1 or 2.

$$w_{ch_1}^{b} \times u_{SAC}^{b}(k) = [\, w_1^b \quad w_2^b \quad \dots \quad w_m^b \,] \begin{bmatrix} u_1^b(k) \\ u_2^b(k) \\ \vdots \\ u_m^b(k) \end{bmatrix} \qquad \text{Eq. 2}$$

As described above, $w_{ch\text{-}i}^{b}$ is the spatial cue information included in the SAC bitstream. When $w_{ch\text{-}i}^{b}$ denotes a power gain in a subband of each channel, $w_{ch\text{-}i}^{b}$ can be predicted from a channel level difference spatial cue. When $w_{ch\text{-}i}^{b}$ is used as a coefficient for compensating a phase difference of frequency coefficients, $w_{ch\text{-}i}^{b}$ can be predicted from a channel time difference spatial cue or an inter-channel coherence spatial cue.

As an example, a case that $w_{ch\text{-}i}^{b}$ is used as a coefficient for compensating the phase difference between the frequency coefficients will be described.

The second matrix of Equation 1 should express a power gain value of each channel and be an inverse of the dimension of the vector of the downmix signal such that an output signal $Y_{SAC}^{b}(k)$ can be created through a matrix operation with the downmix signal outputted from the SAC coder 201.

When the second matrix unit 311 creates a second matrix satisfying Equations 1 and 2, the rendering unit 303 combines the created second matrix with the output of the first matrix unit 313.

The first matrix unit 313 creates an output desiring more than one audio object inputted to the SAOC coder 101, i.e., the first matrix to be mapped to the multi-object audio signal with various channels, based on the control signal, e.g., object control information and play system information.

When the number of audio objects inputted to the SAOC coder 101 is N, the downmix signal outputted from the SAC coder 201 is considered as one audio object and is included in inputted N audio objects. Accordingly, each audio object except the downmix signal outputted from the SAC coder 201 can be mapped to the channel outputted from the SAC decoder 105 based on the first matrix.

When the number of channels outputted from the SAC decoder 105 is M, the first matrix may satisfy a following condition.

$$P \odot W_{oj}^{b} = \qquad \text{Eq. 3}$$

$$\underbrace{\begin{bmatrix} p_{1,1}^b & p_{1,2}^b & \cdots & p_{1,N-1}^b \\ p_{2,1}^b & p_{2,2}^b & \cdots & p_{2,N-1}^b \\ \vdots & \vdots & \ddots & \vdots \\ p_{M,1}^b & p_{M,2}^b & \cdots & p_{M,N-1}^b \end{bmatrix}}_{Matrix\ 1} \odot \begin{bmatrix} w_{oj_1}^b \\ w_{oj_2}^b \\ \vdots \\ w_{oj_N-1}^b \end{bmatrix} = \begin{bmatrix} w_{ch_1}^b \\ w_{ch_2}^b \\ \vdots \\ w_{ch_M}^b \end{bmatrix}_{SAOC}$$

where $w_{oj\text{-}i}^{b}$ is a vector showing information of subband signal $1 \leqq i \leqq N-1$ of an audio object i and is spatial cue information which can be obtained from the SAOC bitstream. When the audio object i is stereo, $w_{oj\text{-}i}^{b}$ is a 2×1 matrix vector. $P_{i,j}^{b}$ is an element vector of the first matrix showing power gain information or phase information for mapping a $j^{th}$ audio object to the $i^{th}$ output channel and can be obtained from control information which is inputted from outside or set up as an initial value, e.g., object control information and play system information.

The first matrix satisfying the condition of Equation 3 is transmitted to the rendering unit 303 and Equation 3 is operated in the rendering unit 303.

An operator and an operating procedure of ⊙ of Equation 3 will be described in detail in Equations 4 and 5.

$$[\, p_{1,1}^b \quad p_{1,2}^b \quad \cdots \quad p_{1,N-1}^b \,] \odot \begin{bmatrix} w_{oj_1}^b \\ w_{oj_2}^b \\ \vdots \\ w_{oj_(N-1)}^b \end{bmatrix} = \qquad \text{Eq. 4}$$

$$[p_{1,1}^b \odot w_{oj_1}^b + p_{1,1}^b \odot w_{oj_2}^b \dots + p_{1,1}^b \odot w_{oj_(N-1)}^b]$$

$$p_{i,j}^b \odot w_{oj_i}^b = [\, p_{1,i,j}^b \quad p_{2,i,j}^b \quad \cdots \quad p_{m,i,j}^b \,] \odot \begin{bmatrix} w_{1,oj_i}^b \\ w_{2,oj_i}^b \\ \vdots \\ w_{m,oj_i}^b \end{bmatrix} \qquad \text{Eq. 5}$$

$$= [\, p_{1,i,j}^b \times w_{1,oj_i}^b \quad p_{2,i,j}^b \times w_{2,oj_i}^b \quad \cdots \quad p_{m,i,j}^b \times w_{m,oj_i}^b \,]$$

When the inputted audio object is mono and stereo, m is 2.

For example, when the number of inputted audio objects is Y; m=2; and the number of outputted channels is M, a dimension of the first matrix is M×Y and Y number of $P_{i,j}^{b}$ is formed as a 2×1 matrix. When the audio object outputted from the SAC coder 201 is included, it is considered that Y=Y−1. As an operation result of Equation 3, a matrix including the power gain vector $w_{ch\text{-}j}^{b}$ of the outputted channel should be able to be expressed. The dimension of the expressed vector is M×2 and reflects M, which is the number of outputted channels, and 2, which is a layout of the inputted audio object.

Referring to FIG. 3 again, the rendering unit 303 receives the first and second matrixes from the first and second matrixes 313 and 311. The rendering unit 303 obtains spatial cue information $w_{oj\text{-}i}^{b}$ of each audio object obtained from the SAOC bitstream divided by the parsing unit 301, obtains desired spatial cue information by combining the output vector calculated based on the first and second matrixes, and creates a representative SAC bitstream including the desired spatial cue information. The desired spatial cue means a spatial cue related to an output multi-channel audio signal which is desired to be outputted from the SAC decoder 105 by a user.

An operation for obtaining the desired spatial cue information based on the first and second matrixes is as shown in Equation 6.

$$pow(p_N)\begin{bmatrix} w^b_{ch_1} \\ w^b_{ch_2} \\ \vdots \\ w^b_{ch_M} \end{bmatrix}_{SAC} + (1 - pow(p_N))\begin{bmatrix} w^b_{ch_1} \\ w^b_{ch_2} \\ \vdots \\ w^b_{ch_M} \end{bmatrix}_{SAOC} = \begin{bmatrix} w^b_{ch_1} \\ w^b_{ch_2} \\ \vdots \\ w^b_{ch_M} \end{bmatrix} = W^b_{modified} \quad \text{Eq. 6}$$

$P_N$ is not considered when the first matrix is created and shows a ratio of sum of power of the audio object outputted from the SAC coder 201 and power of the audio object inputted directly to the SAOC coder 101.

$P_N$ may be expressed as Eq. 7.

$$p_N = \frac{\sum_{k=N-1} \text{power(object \# } k)}{\text{power(object \# } N)} \quad \text{Eq. 7}$$

Therefore, when $w_{ch\text{-}j}{}^b$ is power of the outputted channel, a power ratio of each channel after rendering of the audio objects is shown as $W_{modified}{}^b$. A desired spatial cue parameter can be newly extracted from $W_{modified}{}^b$. For example, extracting a channel level difference (CLD) parameter between ch_2 and ch_1 is as shown in Eq. 8.

$$CLD^b_{ch1/ch2} = 20\log_{10}\frac{w^b_{ch1}}{w^b_{ch2}} = \left[20\log_{10}\frac{w^b_{ch1,1}}{w^b_{ch2,1}}, 20\log_{10}\frac{w^b_{ch1,2}}{w^b_{ch2,2}}\right]_{m=2} \quad \text{Eq. 8}$$

When the transmitted downmix signal is a mono signal, the CLD parameter is as shown in Equation 9.

$$CLD^b_{ch1/ch2} = 10\log_{10}\frac{(w^b_{ch1,1})^2 + (w^b_{ch1,2})^2}{(w^b_{ch2,1})^2 + (w^b_{ch2,2})^2} \quad \text{Eq. 9}$$

A power ratio of the outputted channel is expressed as CLD, which is a spatial cue parameter, the spatial cue parameter between neighboring channels is expressed as a format of various combinations from a given $W_{modified}{}^b$ information. The rendering unit 303 creates an SAC bitstream including the spatial cue extracted from $W_{modified}{}^b$, e.g., the CLD parameter, based on a Huffman coding method.

The spatial cue included in the SAC bitstream created by the rendering unit 303 has analyzing and extracting methods which are different according to a characteristic of the decoder.

For example, the BCC decoder can extract N−1 CLD parameters using Eq. 8 on the basis of one channel. Also, the MPEG surround decoder can extract the CLD parameter according to a comparison order of each channel of the MPEG surround.

That is, the parsing unit 301 divides the SAC bitstream and the SAOC bitstream and the second matrix unit 311 creates the second matrix based on the SAC bitstream divided by the parsing unit 301 and the multi-channel audio signal outputted from the SAC decoder 105 as shown in Eq. 1. The first matrix unit 313 creates the first matrix corresponding to the control signal. The SAOC bitstream divided by the parsing unit 301 is transmitted to the rendering unit 303 and the rendering unit 303 obtains the information of the objects from the transmitted SAOC bitstream, performs operation with the first matrix, combines the operation result with the second matrix, creates the $W_{modified}{}^b$, extracts the spatial cue from the created $W_{modified}{}^b$, and creates the representative SAC bitstream.

That is, the spatial cue extracted from the created $W_{modified}{}^b$ becomes the desired spatial cue. The representative SAC bitstream is a bitstream properly transformed according to the characteristic of the MPEG Surround decoder or the BCC decoder and can be recovered as the multi-object signal with various channels.

Figure 4:
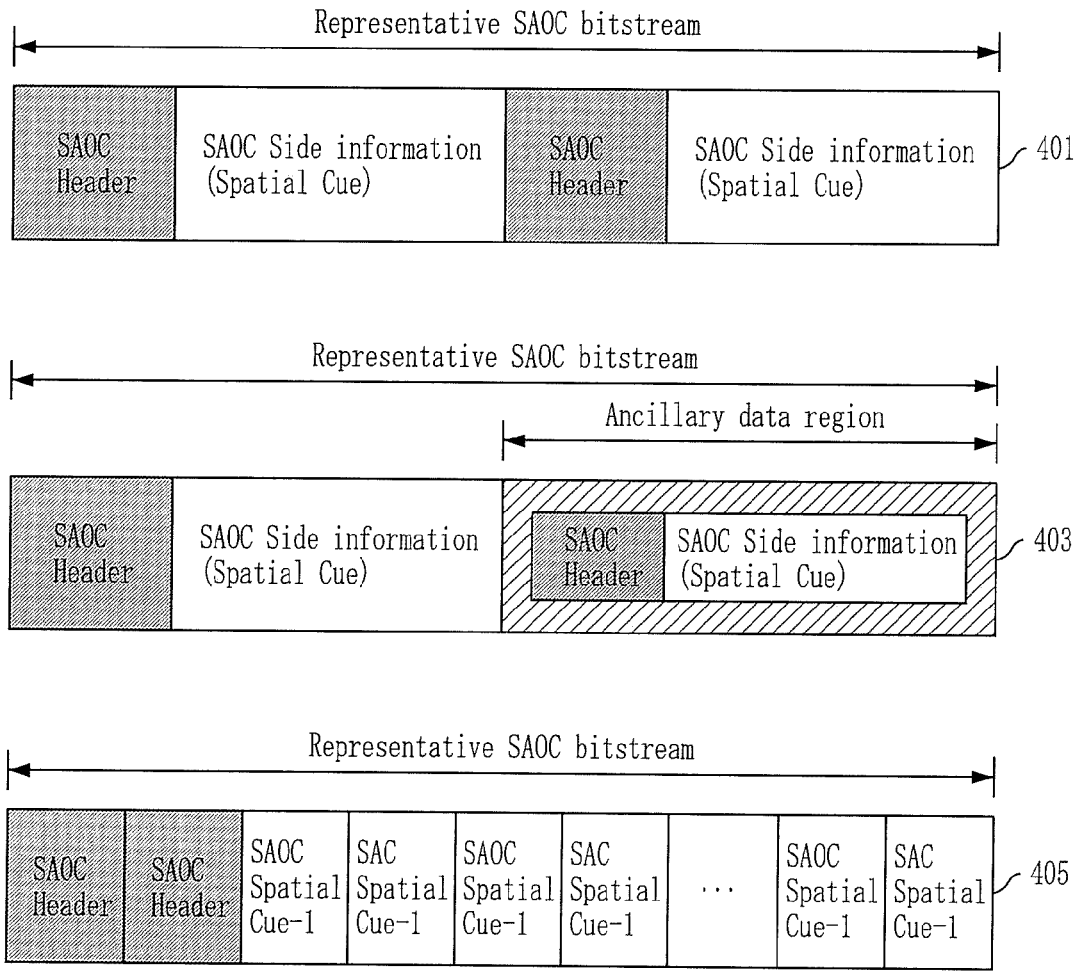
FIG. 4 illustrates a representative spatial audio object coding (SAOC) bitstream created by a bitstream formatter 205 of FIG. 2 in accordance with an embodiment of the present invention.

FIG. 4 illustrates a representative spatial audio object coding (SAOC) bitstream created by a bitstream formatter 205 of FIG. 2 in accordance with an embodiment of the present invention.

Referring to FIG. 4, the representative SAOC bitstream created by the bitstream formatter 205 is created by combining the SAOC bitstream created by the SAOC coder 101 and the SAC bitstream created by the SAC coder 201, and the representative SAOC bitstream includes the preset-ASI bitstream created by the preset-ASI 203. The preset-ASI bitstream will be described in detail with reference to FIG. 5.

A first method for combining the SAOC bitstream and the SAC bitstream is a method for creating one bitstream by directly multiplexing each bitstream. The SAOC bitstream and the SAC bitstream are connected in series in the representative SAOC bitstream (see 401).

A second method is a method for creating one bitstream by including the SAC bitstream information in an SAOC ancillary data region when there is the SAOC ancillary data region. The SAOC bitstream and the ancillary data region are connected in series in the representative SAOC bitstream and the ancillary data region includes the SAC bitstream (see 403).

A third method is a method for expressing a region coding a similar spatial cue in the SAOC bitstream and the SAC bitstream as the same bitstream. For example, a header information region of the representative SAOC bitstream includes the SAOC bitstream header information and the SAC bitstream header information and each certain region of the representative SAOC bitstream includes the SAOC bitstream and the SAC bitstream related to a specific CLD (see 405).

Figure 5:
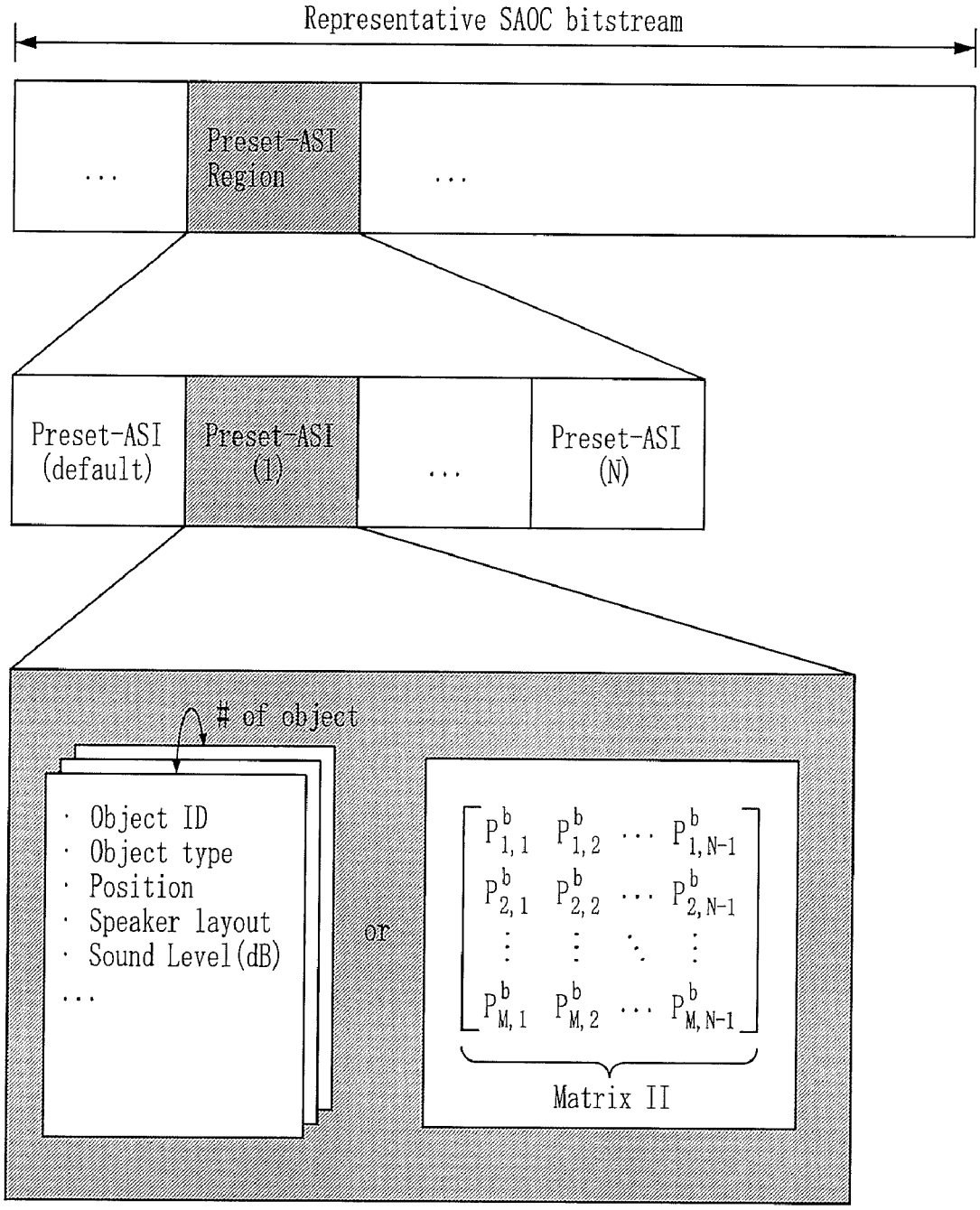
FIG. 5 shows the representative SAOC bitstream of FIG. 2 in accordance with another embodiment of the present invention.

FIG. 5 shows the representative SAOC bitstream of FIG. 2 in accordance with another embodiment of the present invention and shows a case that the representative SAOC bitstream includes a plurality of preset-ASI.

Referring to FIG. 5, the representative SAOC bitstream includes a preset-ASI region. The preset-ASI region includes a plurality of preset-ASI and the preset-ASI includes control information and layout information of the audio object.

When the audio object is rendered based on the transcoder 103, location information, control information and outputted play speaker layout information of each audio object should be inputted.

When the control information and the play speaker layout information are not inputted, the control information and the layout information of each audio object are set up as a default value in the transcoder 103.

Side information or header information of the representative SAOC bitstream or the representative SAC bitstream includes the control information and the layout information set up as the default value, or the inputted audio object control information and the layout information. The control information may be expressed in two ways. First, control information for each audio object, e.g., location and level, and layout information of a speaker are directly expressed. Second, the control information and the layout information of the speaker are expressed in the first matrix format and can be used instead of the first matrix of the first matrix unit 313.

The preset-ASI shows the audio object control information and the layout information of the speaker. That is, the preset-ASI includes the layout information of the speaker and location and level information of each audio object for forming an audio scene proper to the layout information of the speaker.

As described above, the preset-ASI is directly expressed or expressed in the first matrix format to transmit the preset-ASI extracted by the parsing unit 301 to the representative SAC bitstream.

When the preset-ASI is directly expressed, the preset-ASI may include layout of a play system, e.g., a mono/stereo/multiple channel, an audio object ID, audio object layout, e.g., a mono or stereo, an audio object location, an azimuth ranging 0 degree to 360 degree, stereo play elevation ranging −50 degree to 90 degree, and audio object level information −50 dB to 50 dB.

When the preset-ASI is expressed in the first matrix format, a P matrix of Equation 3 reflecting the preset-ASI is formed and the P matrix is transmitted to the rendering unit 303. The P matrix includes power gain information or phase information for mapping each audio object to the outputted channel as an element vector.

The preset-ASI may define diverse audio scenes corresponding to a desired play scenario with respect to the inputted same audio object. For example, the preset-ASI required in a stereo or multiple channel (5.1, 7.1) play system may be additionally transmitted according to an object of a contents producer and a play service.

Figure 6:
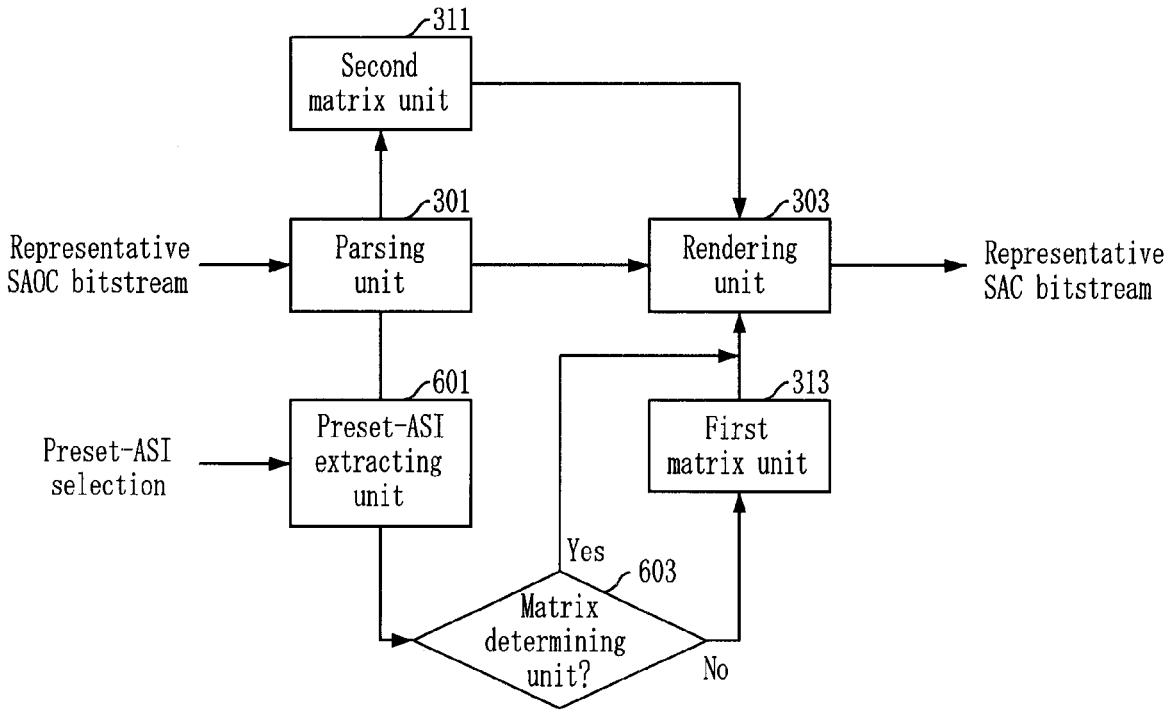
FIG. 6 is a block diagram showing a transcoder 103 of FIG. 2 in accordance with another embodiment of the present invention.

FIG. 6 is a block diagram showing a transcoder 103 of FIG. 2 in accordance with another embodiment of the present invention and shows a case that there is no control signal inputted from outside.

Referring to FIG. 6, the transcoder 103 includes the parsing unit 301 and the rendering unit 303. The transcoder 103 may receive help of the second matrix unit 311, the first matrix unit 313, a preset-ASI extracting unit 601 and a matrix determining unit 603.

As described above, when there is no control signal inputted from outside in the transcoder 103, the preset-ASI is applied.

The parsing unit 301 separates the SAOC bitstream and the SAC bitstream included in the representative SAOC bitstream, parses the preset-ASI bitstream included in the representative SAOC bitstream, and transmits the preset-ASI bitstream to the preset-ASI extracting unit 601.

The preset-ASI extracting unit 601 outputs default preset-ASI from the parsed preset-ASI bitstream. However, when there is a request for selection of the preset-ASI, the requested preset-ASI is outputted.

When the preset-ASI outputted by the preset-ASI extracting unit 601 is the selected preset-ASI, the matrix determining unit 603 determines whether the selected preset-ASI is the first matrix format. When the selected preset-ASI directly expresses the information, the preset-ASI is transmitted to the first matrix unit 313 and the first matrix unit 313 creates the first matrix based on the preset-ASI. When the selected preset-ASI is the first matrix, the preset-ASI is used as a signal directly inputted to the rendering unit 303.

Figure 7:
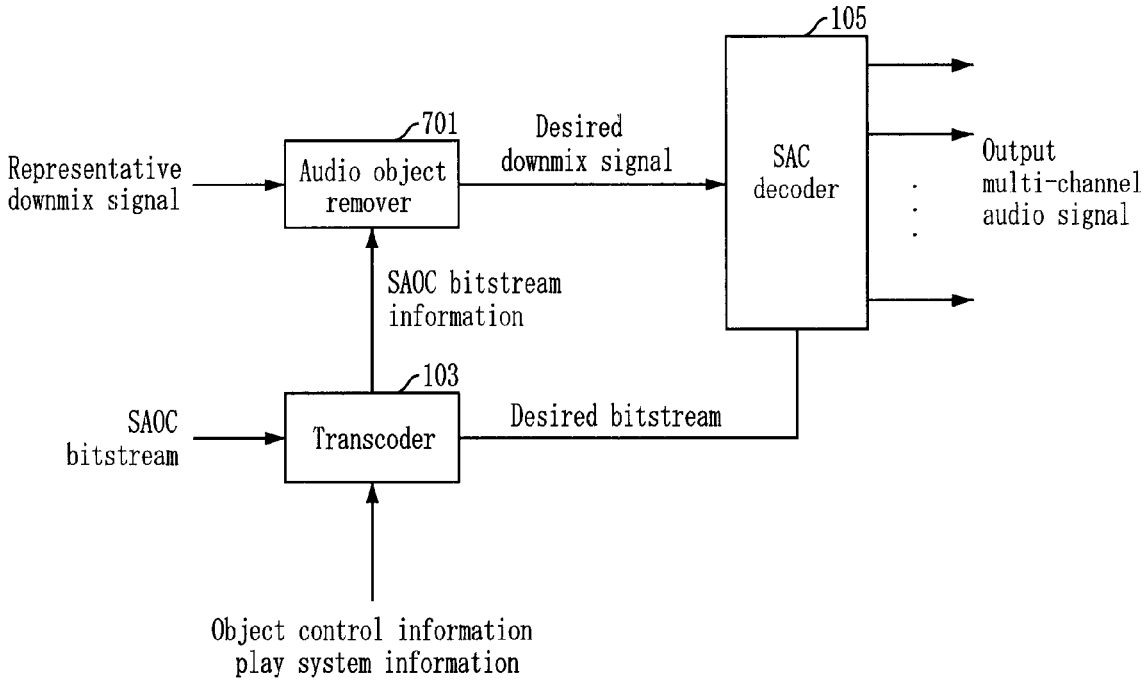
FIG. 7 is a block diagram showing a case that an audio object remover 701 is additionally included in the multi-object audio coder and decoder of FIG. 2.

FIG. 7 is a block diagram showing a case that an audio object remover 701 is additionally included in the multi-object audio coder and decoder of FIG. 2.

Referring to FIG. 7, the audio object remover 701 is used to remove a certain audio object from the representative downmix signal created by the SAOC coder 101. The audio object remover 701 receives the representative downmix signal created by the SAOC coder 101 and the representative SAOC bitstream information from the transcoder 103, and removes a certain audio object. For example, the representative SAOC bitstream information transmitted to the audio object remover 701 may be provided by the rendering unit 303.

For example, a case that only the audio object (object #N), which is a downmix signal of the SAC coder 201, is used as the input signal of the SAC decoder 105 will be described.

The SAOC coder 101 extracts each power size of the inputted audio objects as a CLD value according to each subband, and creates an SAOC bitstream including the CLD value. Power information for a certain subband m can be obtained as follows.

$$P_m^{object\ \#1}, P_m^{object\ \#2}, \ldots, P_m^{object\ \#N}$$

where $P_m^{object\ \#N}$ is a power size of an $m^{th}$ band of the representative downmix signal outputted by the SAOC coder 101. Therefore, u(n) is a representative downmix signal inputted to the audio object remover 701 and U(f) is transforming the representative downmix signal into a frequency region.

When $U^{modified}(f)$ is an output signal of the audio object remover 701, i.e., an input signal of the SAC decoder 105, $U^{modified}(f)$ corresponds to the audio object (object #N) of the downmix signal of the SAC coder 201 and is expressed as Equation 10.

$$U^{modified}(f) = U(f) \times \sqrt{\frac{P_m^{object\ \#N}}{\sum_{i=1}^{N} P_m^{object\ \#_i}}} \times \delta, \quad \text{Eq. 10}$$

$$A(m+1) \le f \le A(m+1) - 1$$

where A(m) denotes a boundary in the frequency region of the $m^{th}$ subband; δ is a certain constant value for controlling a level size; and U(f) is mono or stereo.

A case that U(f) is the mono will be described hereinafter. A case that U(f) is the stereo is the same as the case that U(f) is the mono except that U(f) is divided into left and right channels and processed.

The $U^{modified}(f)$ is considered as the same as the audio object (object #N) which is the downmix signal of the SAC coder 201. Therefore, the representative SAC bitstream inputted to the SAC decoder 105 is a bitstream which excludes the SAOC bitstream from the representative SAOC bitstream and can be used identically with the SAC bitstream outputted from the SAC coder 201. That is, the SAC decoder 105 receives and recovers the object #N into M multi-channel signals. However, a level of an entire signal is controlled by the rendering unit 303 of the transcoder 103 or by modulating the signal level of the object #N by multiplying Equation 10 by a certain constant value.

As an embodiment, a case that only the object #N, which is the downmix signal of the SAC coder 201, is to be removed form the input signal of the SAC decoder 105 will be described.

Equation 10 is the same as Equation 11.

$$U^{modified}(f) = U(f) \times \sqrt{\frac{\sum_{i=1}^{N-1} P_m^{object\ \#_i}}{\sum_{i=1}^{N} P_m^{object\ \#_i}}} \times \delta, \quad A(m+1) \le f \le A(m+1) - 1 \qquad \text{Eq. 11}$$

Therefore, the representative SAC bitstream inputted to the SAC decoder 105 is a bitstream excluding the SAC bitstream of the SAC coder 201 from the representative SAOC bitstream and is considered that there is no output in the second matrix of the rendering unit 303. That is, the transcoder 103 creates a representative SAC bitstream by parsing a representative SAOC bitstream block and rendering only rest audio object information excluding information for the object #N.

Therefore, power gain information and correlation information for the object #N are not included in the representative SAC bitstream. In Equation 11, δ is a certain constant value for controlling a level size, just as Equation 10, and can control an entire output signal level.

The audio object remover 701 removes the audio object from the representative downmix signal and a remove command is determined by the control signal inputted to the transcoder 103. The audio object remover 701 may apply both of a time region signal and a frequency region signal. Also, Discrete Fourier Transform (DFT) or Quadrature Mirror Filterbank (QMF) may be used to divide the representative downmix signal into subbands.

The rendering unit 303 of the transcoder 103 removes and transmits the SAOC bitstream or the SAC bitstream to the SAC decoder 105, and the audio object remover 701 removes the audio object correspondingly to the bitstream transmitted to the SAC decoder 105.

When the transcoder 103 is included in the SAC decoder 105, the representative SAC bitstream outputted from the transcoder 103 may be transmitted to the SAC decoder 105 without an additional transforming procedure. The additional transforming procedure means a general coding procedure such as quantization or a Huffman coding method.

It is considered that the SAOC coder 101 is not connected to the SAC coder 201, and only the audio object inputted to the SAOC coder 101 excluding the output audio object of the SAC coder 201, i.e., object #1 to object #N−1, is controlled and recovered.

Figure 8:
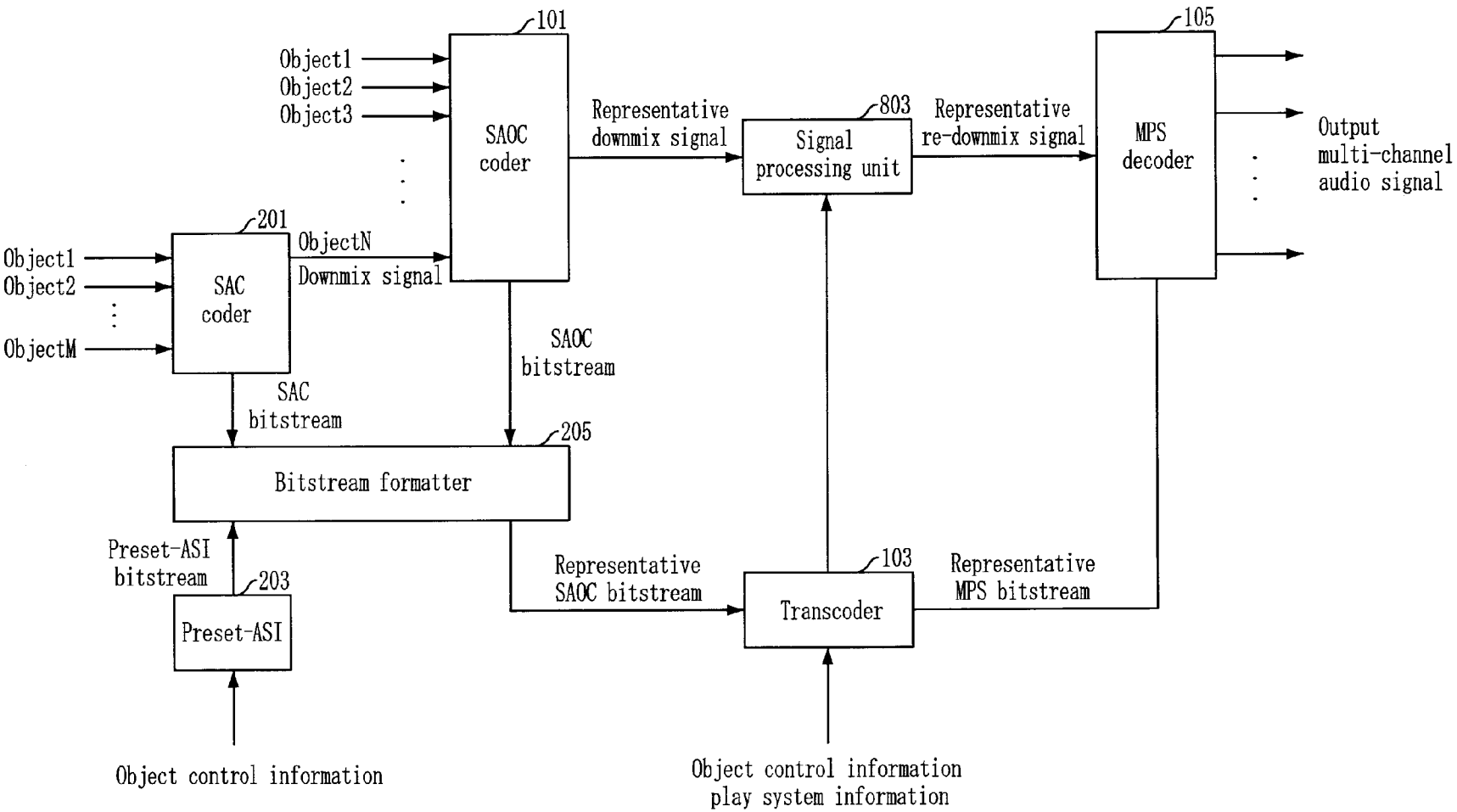
FIG. 8 is a block diagram showing a case that an SAC coder 201 and an SAC decoder 105 of FIG. 2 are replaced by the MPEG surround coder and decoder.

FIG. 8 is a block diagram showing a case that the SAC coder 201 and the SAC decoder 105 of FIG. 2 are replaced by the MPEG surround coder and decoder.

Referring to FIG. 8, the SAC coder 201 is replaced by the MPEG surround coder, i.e., an MPS coder 801, and the SAC decoder 105 is replaced by the MPEG surround decoder, an MPS decoder 805. Also, when the representative downmix signal outputted from the SAOC coder 101 is the stereo, a signal processing unit 803 is additionally required.

The MPS coder 801 performs the same function as the SAC coder 201 of FIG. 2. That is, the MPS coder 801 outputs one audio object from the inputted multi-channel audio signal, extracts the spatial cue and the side information, and creates an MPS bitstream. An outputted audio object is a downmixed mono or stereo signal.

Also, the MPS decoder 805 performs the same function as the SAC decoder 105 of FIG. 2. That is, the MPS decoder 805 recovers a downmix signal outputted from the SAOC coder 101 or a representative re-downmix signal outputted from the signal processing unit 803 as multi-object audio signals with various channels based on the SAC bitstream outputted from the transcoder 103.

Meanwhile, when the downmix signal outputted from the SAOC coder 101 is the stereo, i.e., when the MPS decoder 805 processes a stereo signal, the signal processing unit 803 requires the MPS decoder 805 due to limitation in a left/right process of the stereo signal.

Equation 2 shows a case that the downmix signal is generalized as m numbers in a general SAC decoder. When the downmix signal is the stereo, Equation 2 on a recovered output channel 1 is the same as Equation 12.

$$w_{ch_1}^b \times u_{SAC}^b(k) = [\, w_{L,ch_1}^b \quad w_{R,ch_2}^b \,] \begin{bmatrix} u_L^b(k) \\ u_R^b(k) \end{bmatrix} \qquad \text{Eq. 12}$$

A vector of the output channel should be able to be applied to all downmix signals but it is not possible in a present MPS decoder 805. As shown in Equation 13, it is because the matrix value is limited to 0 in the MPS decoder 805.

$$w_{ch_1}^b \times u_{SAC}^b(k) = [\, w_{L,ch_1}^b \quad 0 \,] \begin{bmatrix} u_L^b(k) \\ u_R^b(k) \end{bmatrix} \qquad \text{Eq. 13}$$

That is, since a $u_2^b(k)$ element is not reflected in recovering the output channel 1, the $w_{ch_2}^b$ created in Equations 3, 4 and 5 cannot be applied. Therefore, flexible positioning on the signal having the layout more than stereo is not possible. That is, free rendering between the left signal and the right signal of the stereo signal is not possible.

However, the representative downmix signal outputted from the SAOC coder 101 is downmixed again based on the signal processing unit 803 and outputted to the representative re-downmix signal. A process of the signal processing unit 803 is as shown in Equation 14.

$$\begin{bmatrix} w_{ch_1}^b \\ w_{ch_2}^b \\ M \\ w_{ch_M}^b \end{bmatrix}_{modified} \times [u_{stereo}^b(k)] = \begin{bmatrix} y_{ch_1}^b(k) \\ y_{ch_2}^b(k) \\ M \\ y_{ch_M}^b(k) \end{bmatrix} \qquad \text{Eq. 14}$$

When the representative downmix signal outputted from the SAOC coder 101 is the stereo, the output signal of the signal processing unit 803 is as shown in Equation 15.

$$\begin{bmatrix} w_L^b \\ w_R^b \end{bmatrix}_{modified} \times [u_{stereo}^b(k)] = \begin{bmatrix} y_{ch_L}^b(k) \\ y_{ch_R}^b(k) \end{bmatrix} \qquad \text{Eq. 15}$$

where $y_{ch_L}^b(k)$ and $y_{ch_R}^b(k)$ are signals outputted by the signal processing unit 803 and inputted to the MPS decoder 805. Since $y_{ch_L}^b(k)$ and $y_{ch_R}^b(k)$ are signals reflecting the rendering of left and right signals as shown in Equation 15, the MPS decoder 805 can output the signal where left and right signals are freely rendered although the MPS decoder 805 is limited as shown in Equation 13.

For example, when $w_L^b$, $w_R^b$ is recovered as 5 channels by the MPS decoder 805, $w_L^b$, $w_R^b$ is expressed as follows in Equation 14.

(e.g., $w_L^b = w_{ch_Lf}^b + w_{ch_Ls}^b + w_{ch_C}^b/\sqrt{2}, w_R^b = w_{ch_Rf}^b + w_{ch_Rs}^b + w_{ch_C}^b/\sqrt{2}$)

As described above, when the MPS decoder 805 has a difficulty in processing the stereo signal due to the limitation of the MPEG surround, the signal processing unit 803 outputs the representative re-downmix signal by performing downmix again based on the object location information transmitted from the transcoder 103. For example, the object location information transmitted to the signal processing unit 803 may be provided by the rendering unit 303. According to a similar method as described above, the rendering unit 303 can create a representative MPS bitstream including the spatial cue information for each of the left and right signals of the audio signal to be outputted by the MPS decoder 805 with respect to the audio signal inputted to the SAOC coder 101 and the MPS coder 801 based on the representative SAOC bitstream.

The MPS decoder 805 can perform the same function as the SAC decoder 105 of FIG. 2 by operating with the signal processing unit 803.

The MPS decoder 805 recovers the representative re-downmix signal outputted from the signal processing unit 803 as a desired output, i.e., a multi-object signal with various channels.

The decoding method of the MPS decoder 805 operating with the SAC decoder 105 or the signal processing unit 803 of FIG. 2 includes the steps of: receiving multi-channel and multi-object downmix signals and multi-channel multi-object side information signals; transforming the multi-channel multi-object downmix signal into multi-channel downmix signals; transforming the multi-channel and multi-object information signals into a multi-channel information signal; synthesizing an audio signal based on the transformed multi-channel downmix signal and multi-channel information signal.

The step of transforming the multi-channel downmix signal includes the step of removing object information from the multi-channel multi-object downmix signal based on object-related information obtained from the multi-channel and multi-object information signals. The step of transforming the multi-channel downmix signal includes the step of controlling object information from the multi-channel multi-object downmix signal based on the object-related information obtained from the multi-channel multi-object information signal.

In the decoding method including the step of transforming the multi-channel downmix signal, the object-related information can be controlled by the object control information. Herein, the object-related information can be controlled by the decoding system information.

Although the coding and decoding procedure in accordance with the present invention is described above in terms of an apparatus, each constituent element included in the apparatus can be replaced by each constituent element required in the perspective of the process. In this case, it is apparent that the coding and decoding procedure in accordance with the present invention may be understood in terms of a method.

The technology of the present invention described above can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to certain preferred embodiments, it will be apparent to those skilled in the art that various changes and modifications may be made without departing from the scope of the invention as defined in the following claims.

INDUSTRIAL APPLICABILITY

The present invention can actively consume audio contents according to user demands by efficiently coding and decoding multi-object audio contents with various channels, and provide compatibility with a conventional coding and decoding apparatus by providing backward compatibility with a conventionally used bitstream.

What is claimed is:

1. An apparatus for coding multi-object audio signals, comprising:

an audio object coding means for coding audio-object signals inputted to the coding apparatus based on a spatial cue and creating rendering information for the coded audio-object signal, where the rendering information includes spatial cue information for the audio-object signals, channel information of the audio-object signals, and identification information of the audio-object signals.

2. The coding apparatus of claim 1, further comprising:

an audio channel coding means for transforming multi-channel audio signals inputted to the coding apparatus into audio-object signals and creating rendering information for the multi-channel audio signal;

a preset sound scene creating means for creating preset information including sound information and play information of the audio-object signal based on a control signal inputted to the coding apparatus; and a representative bitstream creating means for creating a representative bitstream including rendering information outputted from the audio object coding means, rendering information outputted from the audio channel coding means, and the preset information, where the rendering information outputted from the audio channel coding means includes the spatial cue information for the multi-channel audio signals, channel information of the multi-channel audio signals, and identification information of the multi-channel audio signal.

3. The coding apparatus of claim 2, wherein the audio channel coding means is a Moving Picture Experts Group (MPEG) surround coder.

4. A transcoding apparatus for creating rendering information for decoding multi-object audio signals, comprising:

a first matrix means for creating rendering information including power gain information and output location information for coded audio-object signal based on object control information and play information for the coded audio-object signals; and a rendering means for creating spatial cue information for audio signals to be outputted from a decoding apparatus based on the rendering information created by the first matrix means and rendering information for the coded audio-objects signal inputted from a coding apparatus.

5. The transcoding apparatus of claim 4, wherein the rendering means creates spatial cue information for audio-object signals to be outputted from the decoding apparatus except the spatial cue information for predetermined audio-object signals among the coded audio-object signals, and wherein the transcoding apparatus further comprises an audio object removing means for removing the predetermined audio-object signals among the coded audio signals.

6. A transcoding apparatus for creating and rendering information for decoding multi-channel audio signals and the multi-object audio signals, comprising:

a parsing means for separating rendering information for coded audio-object signals and rendering information for multi-channel audio signals from rendering information for coded audio signals inputted from a coding apparatus;

a first matrix means for creating rendering information including power gain information and output location information for the coded audio-object signals based on object control information and play information for the coded audio-object signals;

a second matrix means for creating rendering information including power gain information of each channel on the multi-channel audio signals based on the rendering information for the coded multi-channel audio signals separately acquired by the parsing means; and a rendering means for creating spatial cue information for the audio signals outputted from a decoding apparatus based on the rendering information created by the first matrix means, the rendering information created by the second matrix means, and the rendering information for the coded audio-object signals separately acquired by the parsing means.

7. The transcoding apparatus of claim 6, wherein the object control information and play information for the coded audio-object signals of the first matrix means are preset information inputted from the coding apparatus and including the sound information and the play information of the audio-object signal, and the parsing means further separates the preset information from the rendering information for the coded audio signals inputted from the coding apparatus.

8. The transcoding apparatus of claim 6, wherein the rendering means creates spatial cue information for audio signals to be outputted from the decoding apparatus except spatial cue information for predetermined audio signals among the coded audio signals, and wherein the transcoding apparatus further comprises an audio object removing means for removing audio-object signals on the predetermined audio signals among the coded audio signals.

9. The transcoding apparatus of claim 6, wherein the rendering means creates spatial cue information for each of left and right signals of the audio signals coded by the coding apparatus including Moving Picture Experts Group (MPEG) surround coder as the spatial cue information for the audio signals to be outputted from the decoding apparatus, and wherein the transcoding apparatus transforms the coded audio signals such that the audio signals coded by the coding apparatus including the MPEG surround coder includes left and right signal information.

10. A method for coding multi-object audio signals, comprising the steps of:

coding inputted audio-object signals based on a spatial cue and creating rendering information for the coded audio-object signals, wherein the rendering information includes spatial cue information for the audio-object signals, channel information of the audio-object signals, and identification information of the audio-object signals.

11. The coding method of claim 10, further comprising the steps of:

transforming inputted multi-channel audio signals into audio-object signals and creating rendering information for the multi-channel audio signals;

creating preset information including sound information and play information of the audio-object signal based on an inputted control signal; and creating a representative bitstream including rendering information outputted from the step of coding inputted audio-object signals, rendering information outputted from the step of transforming inputted multi-channel audio signals into audio-object signals and creating rendering information for the multi-channel audio signals, and the preset information, wherein the rendering information outputted from the step of transforming inputted multi-channel audio signals into audio-object signals and creating rendering information for the multi-channel audio signals includes the spatial cue information for the multi-channel audio signal, the channel information of the multi-channel audio signal, and identification information of the multi-channel audio signal.

12. The coding method of claim 11, wherein the step of transforming inputted multi-channel audio signals into audio-object signals and creating rendering information for the multi-channel audio signals is performed in a Moving Picture Experts Group (MPEG) surround coder.

13. A transcoding method for creating rendering information for decoding multi-object audio signals, comprising the steps of:

creating rendering information including power gain information and output location information for coded audio-object signals based on object control information and play information for the coded audio-object signals; and creating spatial cue information for audio signals to be outputted after decoding based on rendering information created in the step of creating rendering information and rendering information for the coded audio-object signals inputted after coding.

14. The transcoding method of claim 13, wherein in the step of creating spatial cue information, spatial cue information for the audio-object signals to be outputted after decoding is created except spatial cue information for predetermined audio-object signals among the coded audio-object signals, and wherein the transcoding method further comprises the step of removing the predetermined audio-object signals among the coded audio signals.

15. A transcoding method for creating rendering information for decoding multi-channel audio signals and multi-object audio signals, comprising the steps of:

separating rendering information for coded audio-object signals and rendering information for the multi-channel audio signal from rendering information for the coded audio signal inputted after coding;

creating rendering information including power gain information and output location information for the coded audio-object signal based on object control information and play information for the coded audio-object signals;

creating rendering information including power gain information of each channel for multi-channel audio signals based on rendering information for the coded multi-channel audio signals separately acquired in the step of separating rendering information; and creating spatial cue information for audio signals to be outputted after decoding based on the rendering information created in the step of creating rendering information including power gain information and output location information, the rendering information created in the step of creating rendering information including power gain information of each channel for multi-channel audio signal, and the rendering information for the coded audio-object signals separately acquired in the step of separating rendering information.

16. The transcoding method of claim 15, wherein in the step of creating rendering information including power gain information and output location information for the coded audio-object signal, the object control information and play information for coded audio-object signal are preset information inputted after coding which includes the sound information and play information of the audio-object signals, and wherein the step of separating rendering information further comprises the step of separating the preset information from the rendering information for the coded audio signals inputted after coding.

17. The transcoding method of claim 15, wherein in the step of creating spatial cue information, spatial cue information for audio signals to be outputted after decoding is created except the spatial cue information for the predetermined audio signal among the coded audio signals, and wherein the transcoding method further comprises the step of removing audio-object signals on the predetermined audio signals among the coded audio signals.

18. The transcoding method of claim 15, wherein in the step of creating spatial cue information for audio signals to be outputted after decoding, spatial cue information for each of left and right signals of the coded audio signals including a Moving Picture Experts Group (MPEG) surround coder is created as spatial cue information for audio signals to be outputted after decoding, and wherein the transcoding method further comprises the step of transforming the coded audio signals such that the coded audio signals including the MPEG surround coder include left and right signal information.

19. A method for decoding multi-object audio signals, comprising the steps of:

receiving multi-channel and multi-object downmix signals and multi-channel multi-object side information signals;

transforming the multi-channel multi-object downmix signal into multi-channel downmix signals;

transforming the multi-channel and multi-object information signals into multi-channel side information signals;

synthesizing audio signals based on the acquired multi-channel downmix signals and multi-channel side information signal.

20. The decoding method of claim 19, wherein the step of transforming the multi-channel downmix signals includes the step of removing object information from the multi-channel and multi-object downmix signals based on object-related information obtained from the multi-channel and multi-object side information signals.

21. The decoding method of claim 20, wherein the object-related information is controlled based on object control information.

22. The decoding method of claim 20, wherein the object-related information is controlled based on decoding system information.

23. The decoding method of claim 19, wherein the step of transforming the multi-channel downmix signals includes the step of controlling object information from the multi-channel multi-object downmix signals based on the object-related information obtained from the multi-channel and multi-object side information signals.

* * * * *